US010944149B2

(12) United States Patent
Ming et al.

(10) Patent No.: US 10,944,149 B2
(45) Date of Patent: Mar. 9, 2021

(54) CONCEALED ANTENNA NODE

(71) Applicant: ALPHA WIRELESS LIMITED, Portlaoise (IE)

(72) Inventors: Cao Ming, Killenard (IE); Fergal Lawlor, Portlaoise (IE); Michal Svarc, Killenard (IE)

(73) Assignee: ALPHA WIRELESS LIMITED, Portlaoise (IE)

( * ) Notice: Subject to any disclaimer, the term of this patent is extended or adjusted under 35 U.S.C. 154(b) by 0 days.

(21) Appl. No.: 15/936,770

(22) Filed: Mar. 27, 2018

(65) Prior Publication Data

US 2018/0277921 A1 Sep. 27, 2018

(30) Foreign Application Priority Data

Mar. 27, 2017 (GB) ..... 1704854.7

(51) Int. Cl.

| | |
|---|---|
| ***H01Q 1/12*** | (2006.01) |
| ***H01Q 1/42*** | (2006.01) |
| ***H01Q 21/20*** | (2006.01) |
| ***H01Q 1/24*** | (2006.01) |
| *H01Q 21/00* | (2006.01) |
| *H01Q 25/00* | (2006.01) |

(52) U.S. Cl.

CPC ..... *H01Q 1/12* (2013.01); *H01Q 1/1207* (2013.01); *H01Q 1/1242* (2013.01); *H01Q 1/246* (2013.01); *H01Q 1/42* (2013.01); *H01Q 21/20* (2013.01); *H01Q 21/00* (2013.01); *H01Q 25/00* (2013.01)

(58) Field of Classification Search

CPC ..... H01Q 1/12; H01Q 1/1207; H01Q 1/246; H01Q 1/42

See application file for complete search history.

(56) References Cited

U.S. PATENT DOCUMENTS

| | | | | |
|---|---|---|---|---|
| 2,848,182 | A * | 8/1958 | Wildberg | H01Q 3/005 248/541 |
| 2005/0156799 | A1* | 7/2005 | Theobold | H01Q 1/088 343/725 |
| 2008/0175216 | A1 | 7/2008 | Nasco | |
| 2009/0303147 | A1 | 12/2009 | Choudhury | |
| 2013/0100867 | A1 | 4/2013 | Boch | |
| 2015/0349399 | A1* | 12/2015 | Lasier | H01Q 1/06 343/721 |
| 2016/0050715 | A1* | 2/2016 | Porter | H04W 88/08 455/562.1 |

(Continued)

FOREIGN PATENT DOCUMENTS

| | | |
|---|---|---|
| GB | 2510390 | 8/2014 |
| GB | 2511732 | 9/2014 |

(Continued)

*Primary Examiner* — Daniel Munoz

(74) *Attorney, Agent, or Firm* — Renner Kenner Greive Bobak Taylor & Weber

(57) ABSTRACT

A concealed antenna node for mounting on a street pole comprises an antenna with an associated radio module which are pre-wired together and housed within a radome of the concealed antenna node. The antenna comprises a plurality of antenna columns arranged about a central section within which the radio module is located. The antenna columns are arranged in a spaced-apart formation such that a gap is realised between adjacent antenna columns.

13 Claims, 15 Drawing Sheets

(56) References Cited

U.S. PATENT DOCUMENTS

| | | | |
|---|---|---|---|
| 2016/0381574 | A1 | 12/2016 | Dudzinski et al. |
| 2017/0110780 | A1 | 4/2017 | Dipiero |
| 2017/0244176 | A1 | 8/2017 | Ming et al. |

FOREIGN PATENT DOCUMENTS

| | | | |
|---|---|---|---|
| GB | 2512858 | | 10/2014 |
| JP | 2012167956 | A | 9/2012 |
| WO | 9853522 | A1 | 11/1998 |
| WO | 2010008902 | A1 | 1/2010 |

* cited by examiner

Single Sector Pattern

Omni Pattern

Back to Back Pattern

Side by Side Pattern

CONCEALED ANTENNA NODE

INTRODUCTION

This invention relates to an antenna. In particular, the present invention is directed towards a concealed antenna node for deployment on street poles.

Throughout this specification, the term "street pole" shall be understood to encompass any type of mast, metallic pole, wooden pole or tower which may be used for supporting electricity cabling, street lighting, street signage, traffic lights and so on. It is primarily envisaged to deploy the antenna of the present invention on a street pole which is being used for a separate purpose, such as mounting a street sign; although it is also within the scope of the present invention for the antenna to be deployed on a street pole which is used solely for the purposes of mounting the antenna. It is further envisaged that the present antenna design may be deployed on poles which are affixed to the side of buildings and other structures, so whilst the present specification is predominately directed towards the use of the antenna design on street poles, it will not be limited to just this use.

Throughout the following specification, reference to an "antenna column" shall be understood to refer to an outwardly facing component of an antenna, whereby the antenna column will mount one or more antenna radiator elements that are capable of directing a beam of radiation from the radiators.

Throughout the following specification, reference to a "radiator", an "antenna radiator", a "radiator element", a "radiation element", and/or an "antenna radiation element" shall be understood to refer to the component of the antenna which transmits/radiates the antenna beam.

Throughout the following specification, a "radome" will be interpreted as referring to a protective housing for an antenna housed within, whereby the radome material will permit transmission and/or reception of an antenna beam through the radome material, with a minimum amount of attenuation of the antenna beam.

It is becoming increasingly difficult to obtain planning permissions to erect antenna towers. However, due to the rapid increase in demand for mobile data, it has become necessary to expand the capacity of the existing data networks considerably. As a majority of the demand for mobile data is in cities, the expansion of the data networks in these cities is a priority.

The challenge associated with deploying antennae in cities is that the antennae have to be at street level, where the antennae are generally considered to be an eyesore and aesthetically unattractive by the public. As such, many municipalities and local authorities in cities are disinclined to allow antennae to be erected at street level, for these reasons. A lot of so-called street furniture already exists and it has been proposed to install the antennae on existing street poles and buildings, as this will causing less disruption during installation and will not require a separate tower for mounting the antennae. However, the issue with the aesthetics of the antennae still persist.

Turning to FIG. 1, a prior at example of a relatively small cell tower is shown. This type of cell tower could be used as a Base Transceiver Station (BTS) in a city. It will be understood for the purposes of the present specification, the term "antenna node" is to be interpreted as a cellular network apparatus which comprises one or more of: an antenna, a radio module, a backhaul, power equipment and/or associated wiring and cabling so as to form a BTS. In FIG. 1, the antenna node is indicated generally by reference numeral 100 and comprises an antenna 102, a radio module 104, a backhaul 106, power equipment 108 and cabling 110; and, all of these components 102, 104, 106, 108, 110 are all supplied as separate components and installed on top of a street lighting pole 112 separately from one another. As can be seen, this is aesthetically undesirable.

In some cases, as shown in FIG. 2, a further antenna node is indicated generally by reference numeral 200 and the backhaul, the power equipment and much of the cabling have been combined with the radio module 206 to form a less conspicuous antenna installation. Nonetheless the antenna design is still an eyesore comprising a separate antenna 202 installed separately on a street pole 204.

Communication apparatus which mounts a radio module together with an associated antenna arrangement is disclosed in US 2013/100869, GB 2,512,858, GB 2,510,390, GB 2,511,732, US 2009/303147 and US 2008/175216.

It is a goal of the present invention to provide an antenna node that overcomes at least one of the above mentioned problems.

SUMMARY OF THE INVENTION

The present invention is directed to a concealed antenna node which can be used as a BTS on its own, or forms a main part of a BTS deployment by virtue of a large number of the components required to establish the BTS being provided within the concealed antenna node. To this end and throughout this specification, a 'concealed antenna node' will be understood to comprise at least the antenna and the radio module (all being prewired together) within a radome. Of course, it is also possible, and indeed preferable, that the backhaul and power equipment for the BTS be also provided within the radome and be prewired together to the other equipment within the radome so as to form the concealed antenna node.

The present invention is directed towards a concealed antenna node suitable for mounting on a street pole, the concealed antenna node comprising an antenna and an associated radio module which are both housed within a radome of the concealed antenna node; the antenna comprising a plurality of antenna columns, whereby the plurality of antenna columns are arranged about a central section; the radio module being located within the central section and inside the radome; and, the antenna and the radio module being pre-wired together within the radome to form the concealed antenna node suitable for mounting on the street pole.

The advantage of providing the concealed antenna node of the present invention is to provide an antenna which can accommodate the radio module within a central section which is formed by the arrangement of the antenna columns of the antenna around the central section. In this way, the radio module can be concealed within the centre of the antenna and thus allow both the antenna and the radio module to be housed within a radome, which would normally only house the antenna. Therefore, only one component (i.e. the concealed antenna node) will be mounted on the street pole.

In a further embodiment, the plurality of antenna columns are arranged in a spaced-apart formation such that a gap is realised between adjacent antenna columns. Intentionally forming a gap between adjacent antenna columns is undesirable as this will affect the radiation pattern negatively. The gap between adjacent antenna columns will cause a degradation in the radiation pattern coverage over a cell area, which is normally undesirable from an antenna design perspective. Such a degradation in radiation pattern coverage is shown in FIG. 11, in relation to a three sector omnidirectional antenna. In this inventive solution, by acting contrary to the normal design motivations of an antenna designer, the antenna columns may be arranged in a spaced-apart fashion so as to allow a radio module to fit inside a central area of the arrangement of the antenna columns and thus the radio module and antenna can be packaged together inside a single radome. Although the radome size will also be larger than normal, which is again contrary to normal design wishes, it will allow both components to fit inside and overall be more aesthetically pleasing and easier to install as a single concealed antenna node, rather than multiple separate components.

In a further embodiment, the plurality of antenna columns are arranged in a ring arrangement about the central section. In a further embodiment, the plurality of antenna columns are arranged in an open ring arrangement about the central section.

In a further embodiment, the plurality of antenna columns are arranged in a triangular arrangement about the central section. In a further embodiment, the plurality of antenna columns are arranged in a rectangular arrangement about the central section. In a further embodiment, the plurality of antenna columns are arranged in a hexagonal arrangement about the central section. In a further embodiment, the plurality of antenna columns are arranged in a dodecagonal arrangement about the central section.

In a further embodiment, the concealed antenna node further comprises a backhaul which is prewired to the antenna and/or radio module, within the radome. In a further embodiment, the concealed antenna node further comprises power equipment which is prewired to the antenna and/or radio module and/or backhaul, within the radome.

In another embodiment, the radome comprises a cylindrical body having an upper end closed by an upper cap and a lower end closed by a lower cap, the lower cap having an outwardly projecting central collar for reception of a pole to mount the concealed antenna node on the pole.

In another embodiment, one or both of the upper cap and the lower cap has a vent.

All of the component parts of a BTS can be advantageously combined into a single unit, which is prewired and can be easily and quickly installed on top of a pole. This reduces the length of time which installers deploying the BTS would need to spend working at height.

In a further embodiment, the diameter of the radome is at least 300 mm. In a further embodiment, the diameter of the radome is at least 400 mm. In a further embodiment, the diameter of the radome is at least 500 mm. Normally, a radome would be in the region of 100 mm to 180 mm, and be designed to be a small as possible; whereas, the design of the present invention is carried out counter-intuitively to the normal motivations which would drive an antenna designer.

DETAILED DESCRIPTION OF EMBODIMENTS

The invention will be more clearly understood from the following description of some embodiments thereof, given by way of example only, with reference to the accompanying drawings, in which.

Figure 1:
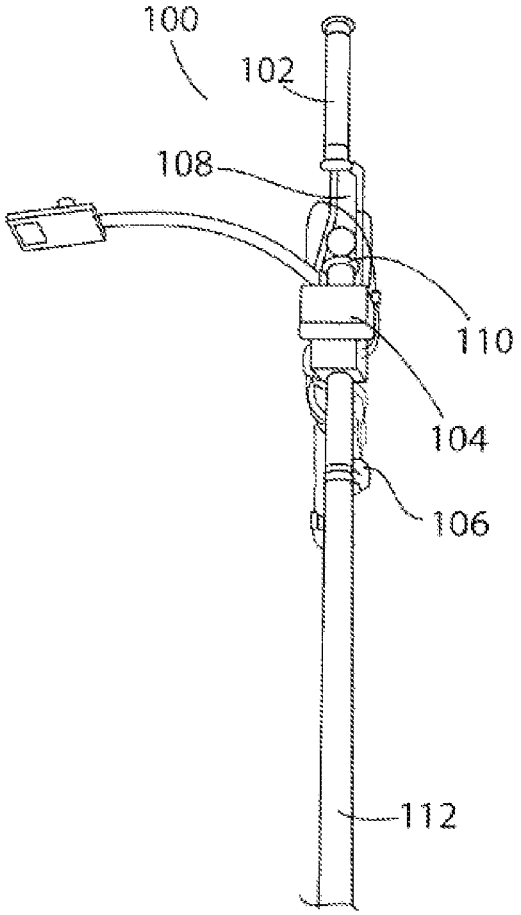
Figure 1 (Prior Art)
FIG. 1 is a perspective view of an antenna node in accordance with the prior art, shown mounted on a street pole.
Figure 2:
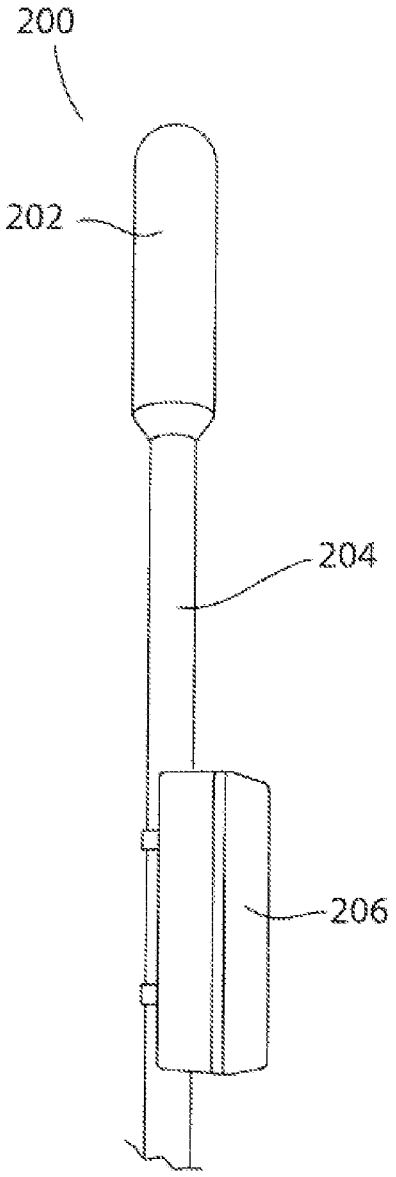
Figure 2 (Prior Art)
FIG. 2 is a perspective view of another antenna node in accordance with the prior art, shown mounted on a street pole.
Figure 3:
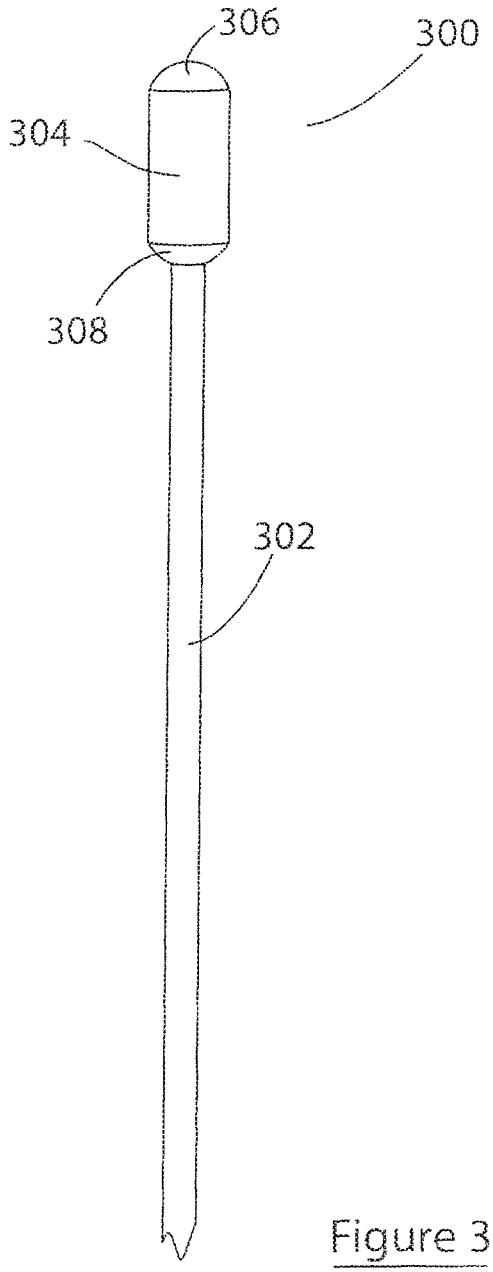
FIG. 3 is a front perspective view of a concealed antenna node in accordance with the present invention mounted on top of a street pole.

Referring to FIG. 3, there is provided a concealed antenna node indicated generally by reference numeral 300. The concealed antenna node 300 comprises a spherocylindrical radome 304. The spherocylindrical radome 304 comprises a cylindrical body 305 having a substantially hemispherical upper cap end 306 and a substantially hemispherical lower cap end 308. The concealed antenna node 300 is mounted on top of a street pole 302.

Figure 4:
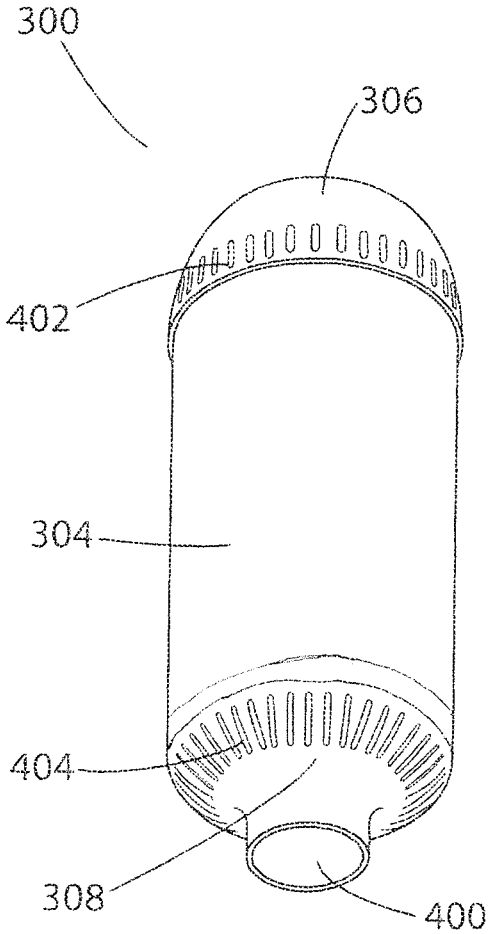
FIG. 4 is a front bottom perspective view of the concealed antenna node of FIG. 3.
Figure 5:
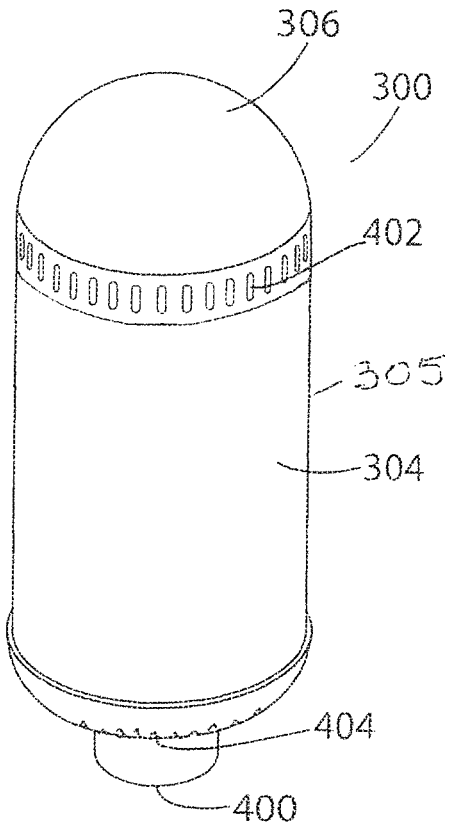
FIG. 5 is a front top perspective view of the concealed antenna node of FIG. 3.
Figure 6:
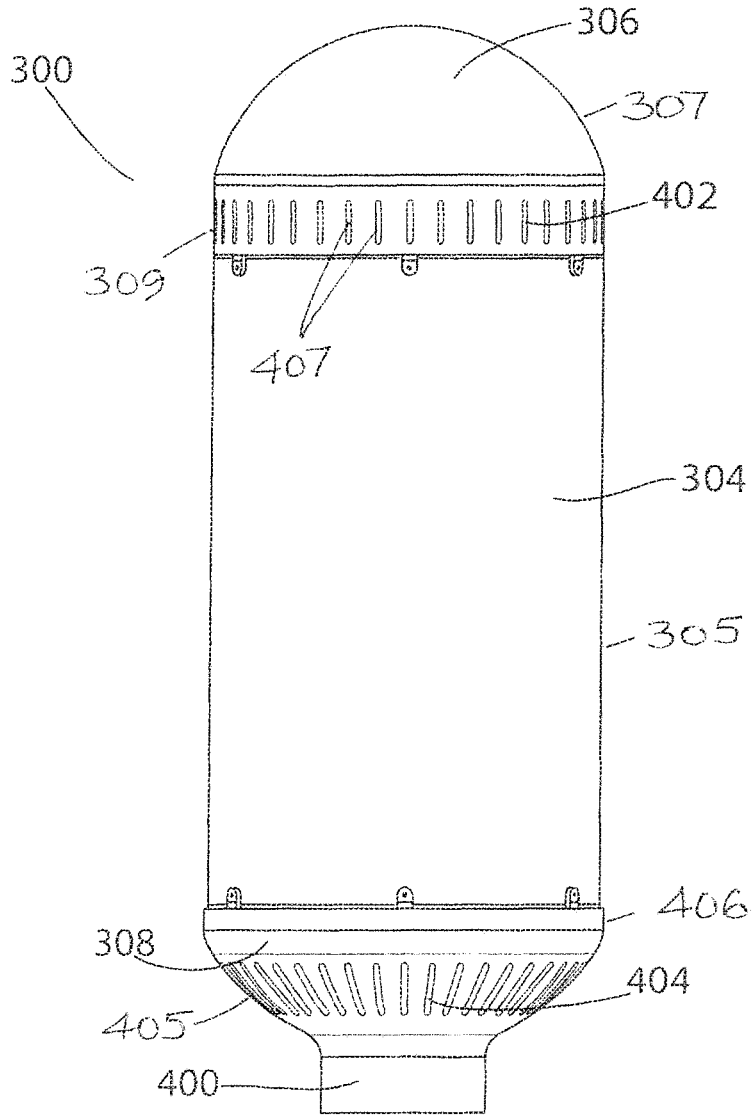
FIG. 6 is a front elevational view of the concealed antenna node of FIG. 3.

Looking now at FIGS. 4 to 6 inclusive, an exterior of the concealed antenna node 300 is shown in more detail. The upper cap end 306 has a domed top portion 307 with a downwardly depending cylindrical peripheral skirt 309 which attaches to the body 305. Similarly, the lower cap end 308 has a domed bottom portion 405 with an upwardly extending cylindrical peripheral skirt 406. The concealed antenna node 300 comprises an upper vent 402 and a lower vent 404. The upper vent 402 is formed by a plurality of circumferentially spaced-apart slots 407 in the skirt 309 of the upper cap end 306. The lower vent 404 is formed by spaced-apart slots 408 in the bottom portion 405 of the lower cap end 308. A collar 400 is provided to depend downwardly from the hemispherical bottom cap end 308 and assist in mounting the concealed antenna node 300 to the street pole 302.

Figure 7:
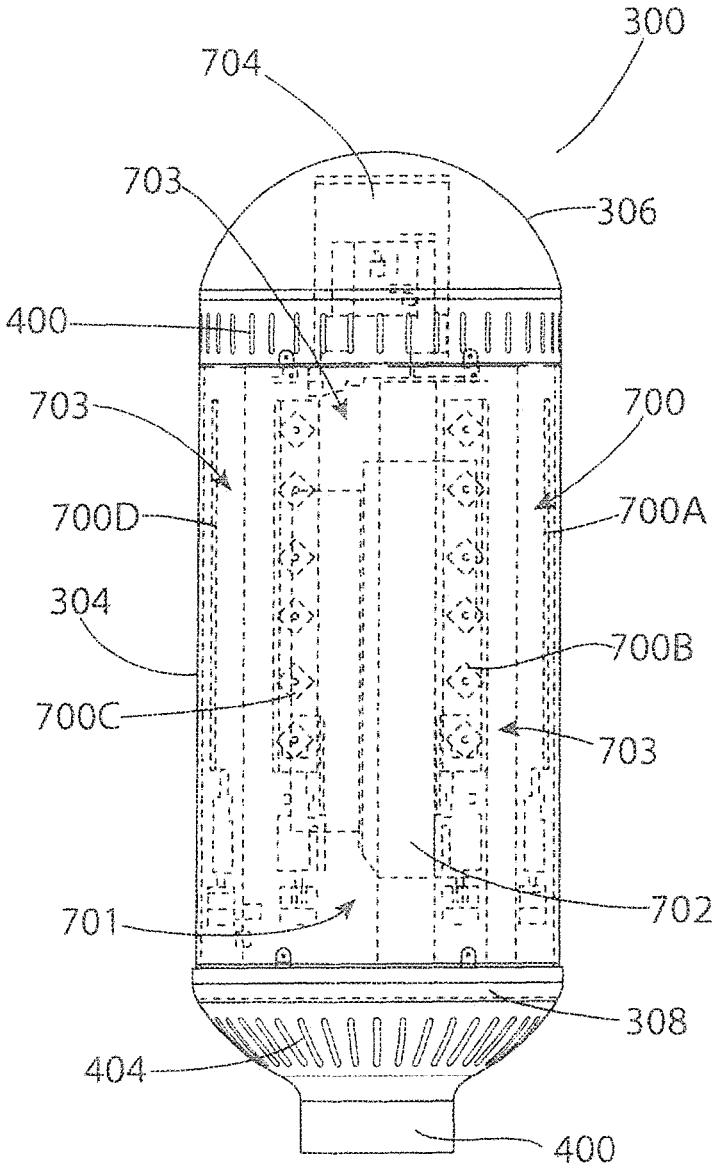
FIG. 7 is a diagrammatic view of the concealed antenna node of FIG. 6, showing internal components in dashed lining.

Turning to FIG. 7, the interior components of the concealed antenna node 300 are shown in phantom lining. An antenna indicated generally by reference numeral 700 comprises a plurality of antenna columns 700A, 700B, 700C, 700D, and this antenna 700 is arranged within the radome 304. The antenna columns 700A, 700B, 700C, 700D are arranged about a central section indicated generally by reference numeral 701. In the embodiment shown in FIG. 7, the antenna columns 700A, 700B, 700C, 700D are arranged in a spaced-apart fashion such that a gap 703 is realised between adjacent antenna columns 700A, 700B, 700C, 700D. It is disadvantageous to have such a gap 703 between adjacent antenna columns 700A, 700B, 700C, 700D as this negatively impacts the radiation pattern coverage which is created by such spaced apart antenna columns 700A, 700B, 7000, 700D. It will be understood that further antenna columns are also mounted within the radome 304 and the antenna columns shown, and unseen, together form an open ring about the central section 701 defining a central chamber within which the radio module 702 is mounted.

A radio module 702 is located within the central section 701 and is inside the radome 304 of the concealed antenna node 300. It will be understood that the radio module 702 comprises one or more of: an eNodeB, a Base Station, a Small Cell Radio, a Mini Macro Radio, a Macro Radio and/or a Remote Radio Head. The antenna 700 and the radio module 702 are pre-wired together (not shown) within the radome 304 to form the concealed antenna node 300 suitable for mounting on a street pole. In this way all of the components are housed together in a single unit which will suffer less from wind loading when compared to the accumulated wind loading on separately deployed components, and, will be quicker and easier to install on a street pole when compared to installing a multitude of separate components and is a more aesthetically pleasing and acceptable arrangement.

A backhaul 704 is located within the substantially hemispherical upper cap end 306. It will be appreciated that the location of the backhaul 704 could be changed as the physical size of the backhaul 704 will be less than that of the radio module 702. The radio module 702 would normally be the largest component and it is most advantageous to place the radio module 702 within the central section 701 of the concealed antenna node 300.

Figure 8:
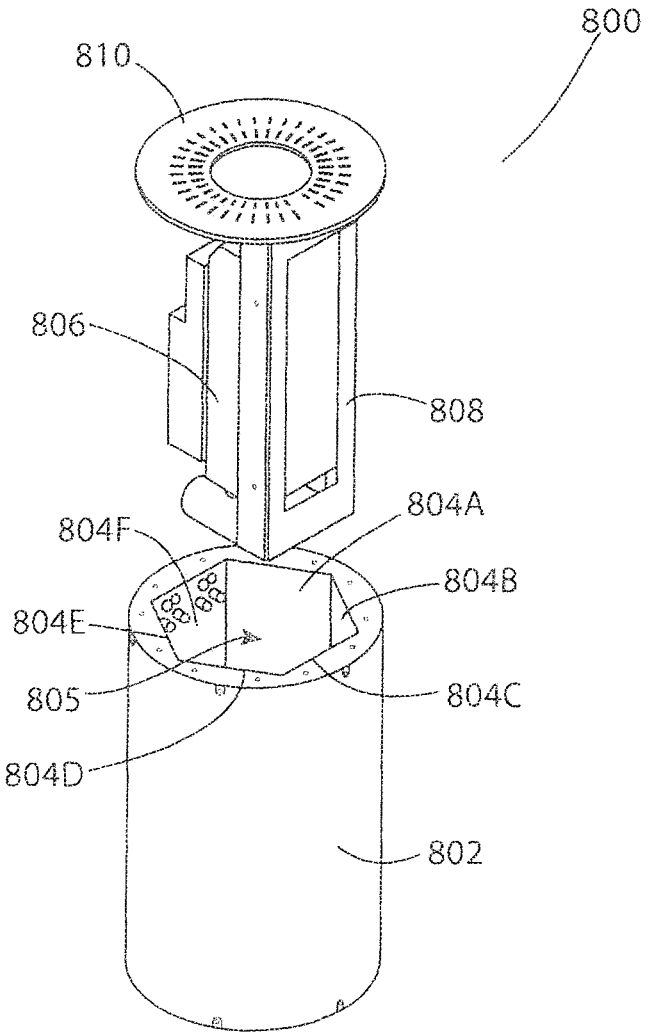
FIG. 8 is an exploded perspective view of parts of a concealed antenna node according to the invention.

Referring to FIG. 8, a further embodiment of the present invention is shown where a part of a concealed antenna node according to the invention, indicated generally by reference numeral 800, is shown in exploded view. A cylindrical body of a radome 802 houses six antenna columns (not shown) in an open ring arrangement. Six interior faces 804A, 804B, 804C, 804D, 804E, 804F are shown to contact with each adjacent interior face, but it will be readily understood that the antenna columns connected to an opposing side of these interior faces will not be as wide as the interior faces and thus a gap will be formed between adjacent antenna columns. The open ring arrangement of the antenna columns is used so as to permit a radio module 806 sitting inside a cradle 808 to be lowered and installed inside a central section indicated generally by reference numeral 805 of the concealed antenna node 800. A vented top plate 810 is also provided and comprises a through hole to allow a component which sits above the vented top plate 810 (for example, a backhaul) to be prewired to the components located below the vented top plate 810.

Figure 9:
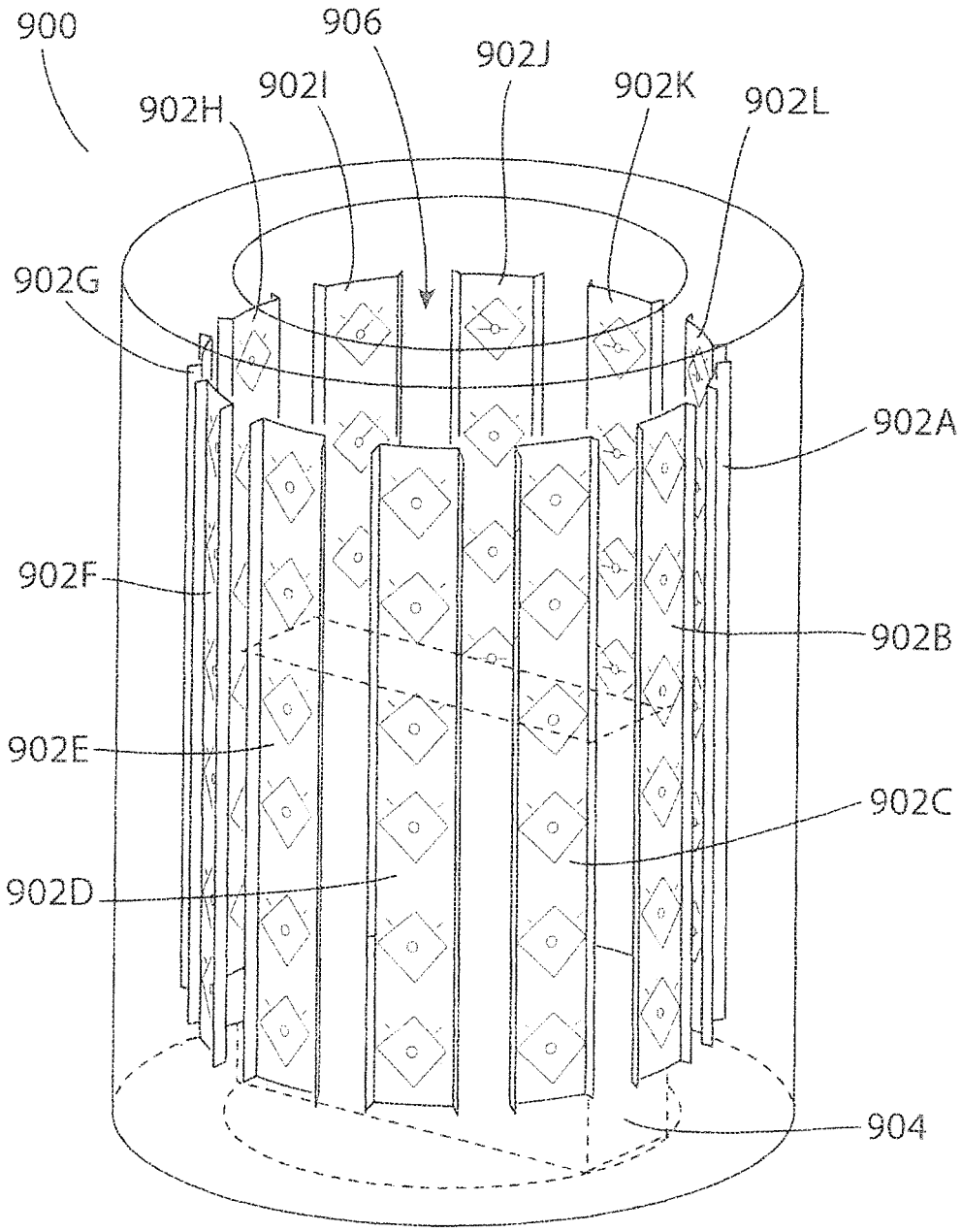
FIG. 9 is a perspective view of a radio module of a concealed antenna node and a plurality of antenna columns of a concealed antenna node arranged in a spaced-apart fashion in accordance with the present invention.
Figure 10:
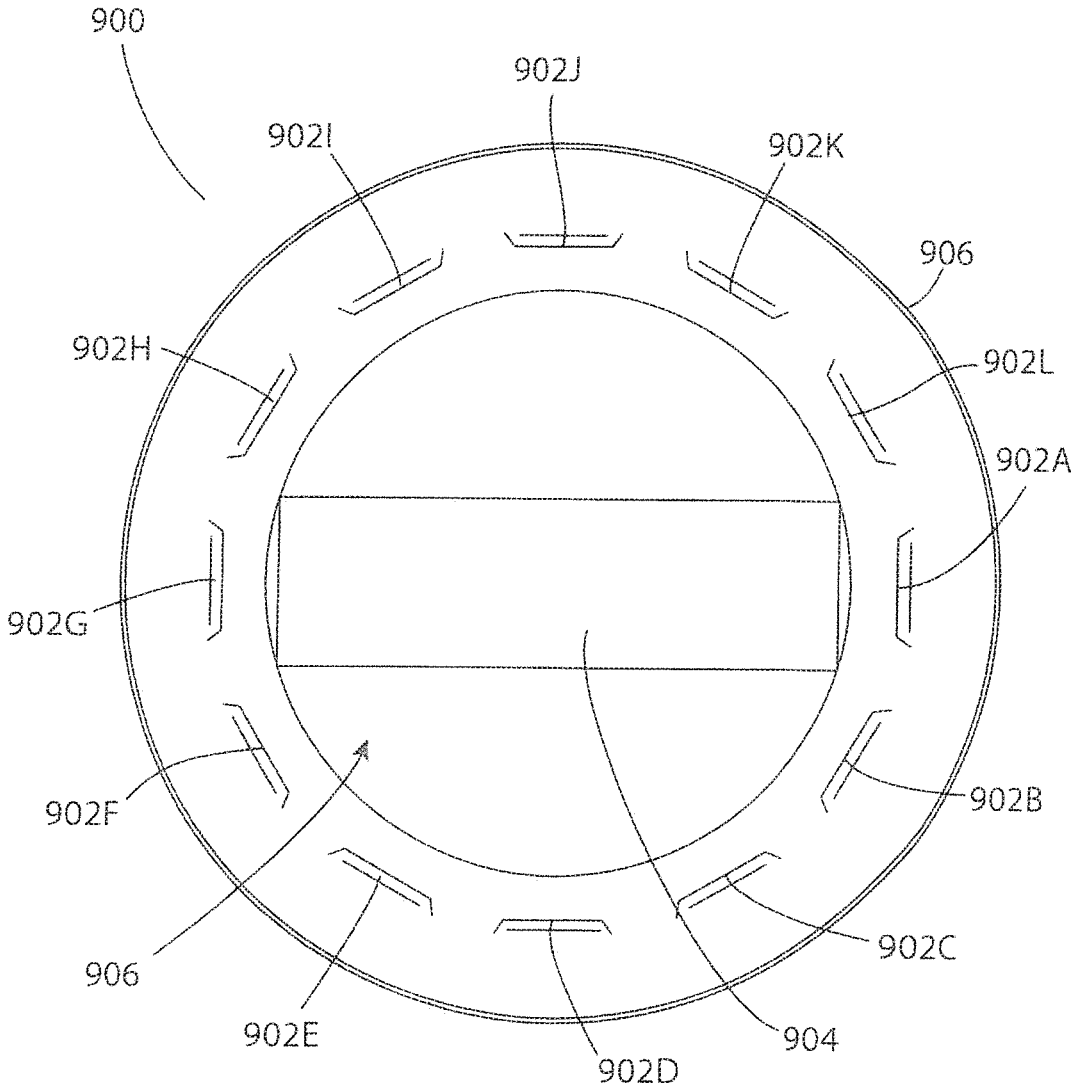
FIG. 10 is a top view of the radio module and plurality of antenna columns shown in FIG. 9.
Figure 11:
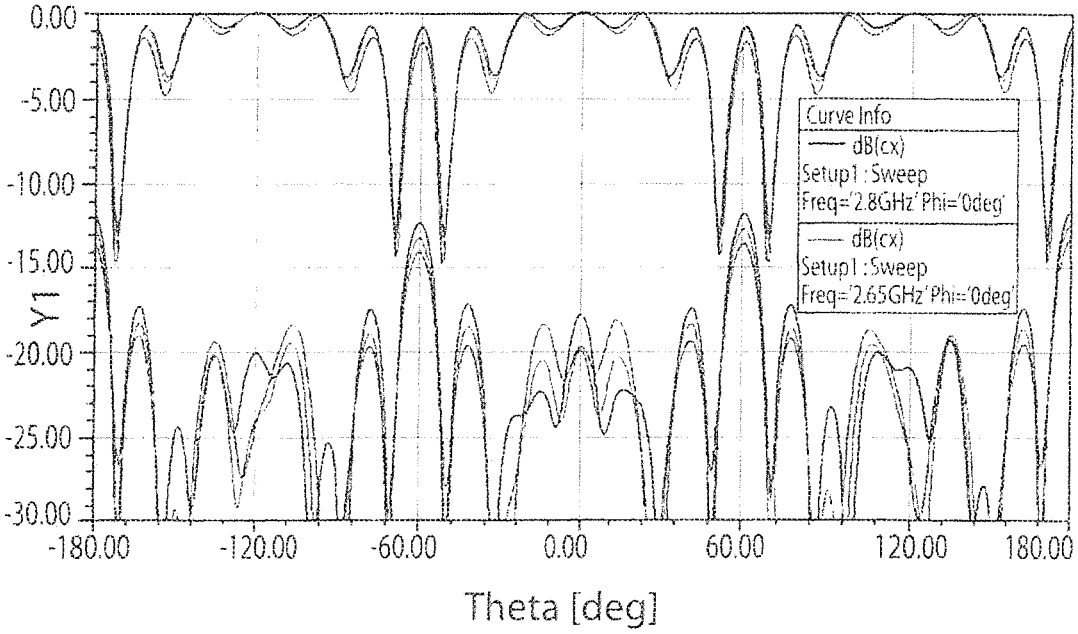
FIG. 11 is a radiation plot of a three sector omnidirectional antenna which has been realised in accordance with the present invention.
Figure 12:
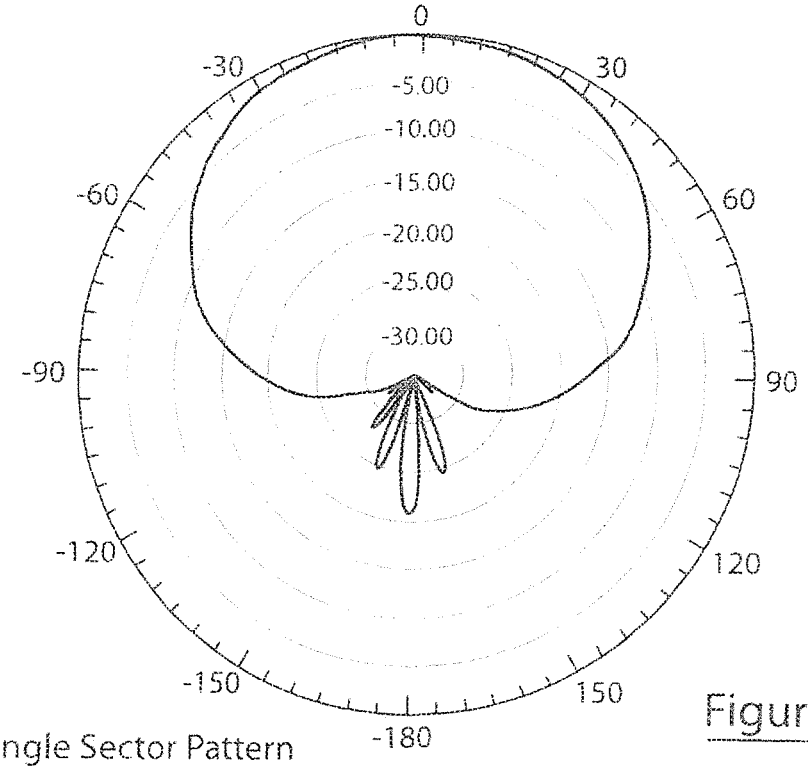
FIG. 12 to FIG. 15 are pattern plots showing different formation of patterns depending on what sections are combined or not.
Figure 13:
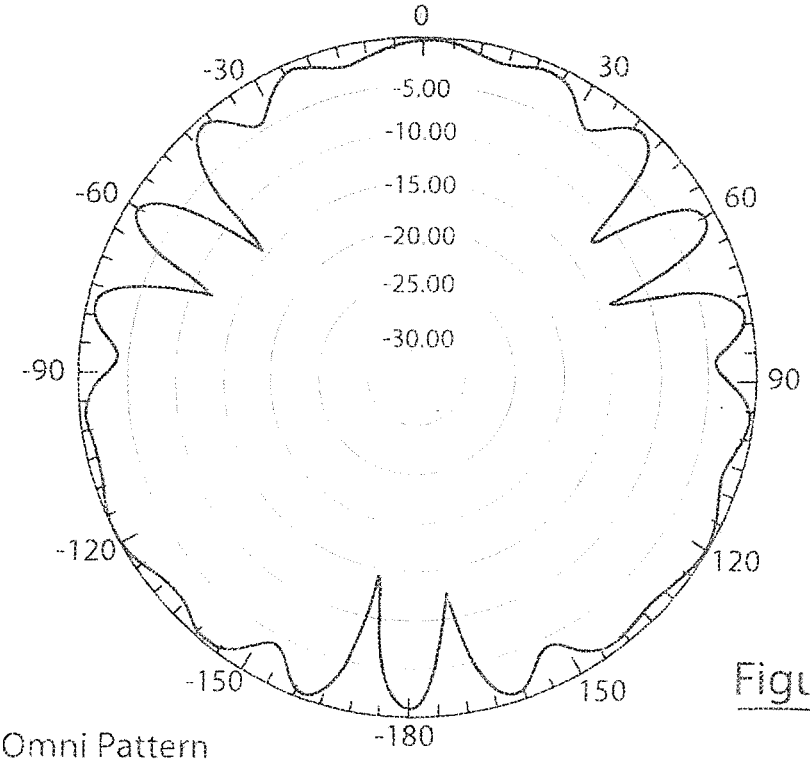
Figure 14:
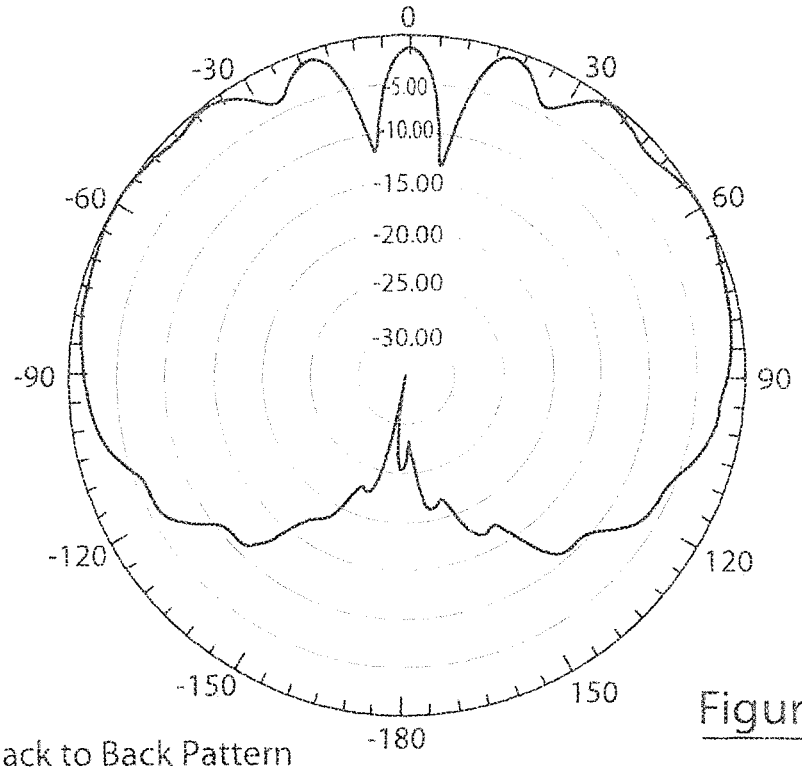
Figure 15:
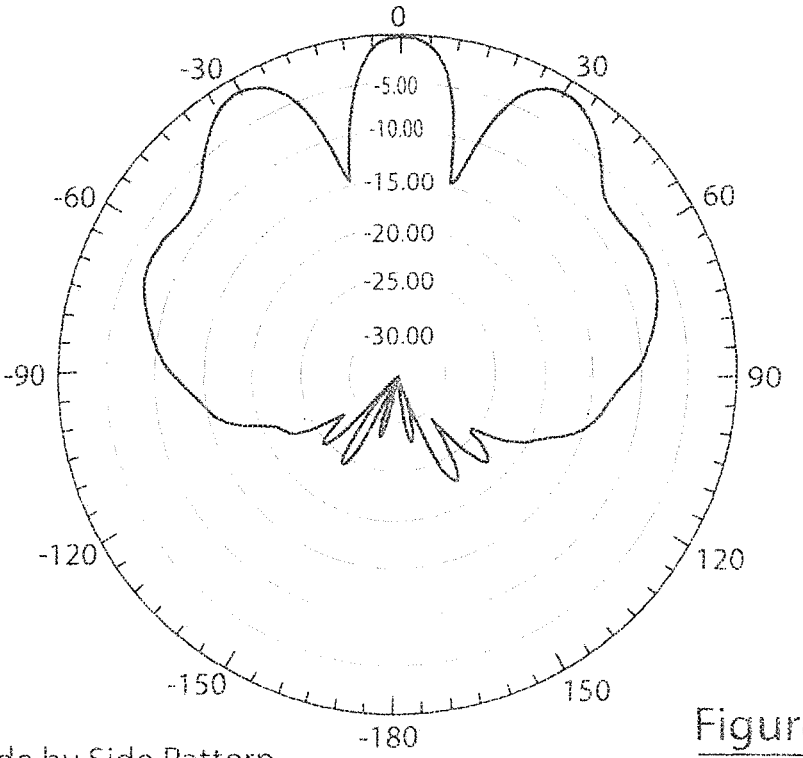

FIGS. 9 and 10 show a further example of the present invention where twelve antenna columns are used to provide the radiation pattern. A concealed antenna mode 900 comprises twelve circumferentially spaced-apart antenna columns 902A, 902B, 902C, 902D, 902E, 902F, 902G, 902H, 902I, 902J, 902K, 902L which are arranged in an open ring formation with gaps between adjacent antenna columns 902A, 902B, 902C, 902D, 902E, 902F, 902G, 902H, 902I, 902J, 902K, 902L. The radio module 904 is again mounted within a central section indicated generally by reference numeral 906. As before, this twelve antenna column embodiment is designed with adjacent antenna columns being spaced apart so that a sufficient amount of space is created inside the central section 906 to accommodate the radio module 904. This permits the concealed antenna node 900 to be located within a single radome which can be prewired in a factory and prepared for a relatively straight forward installation on a street pole.

FIGS. 12 to 15 show radiation pattern plots showing the different formation of patterns depending on what sections are combined or not.

Figure 16:
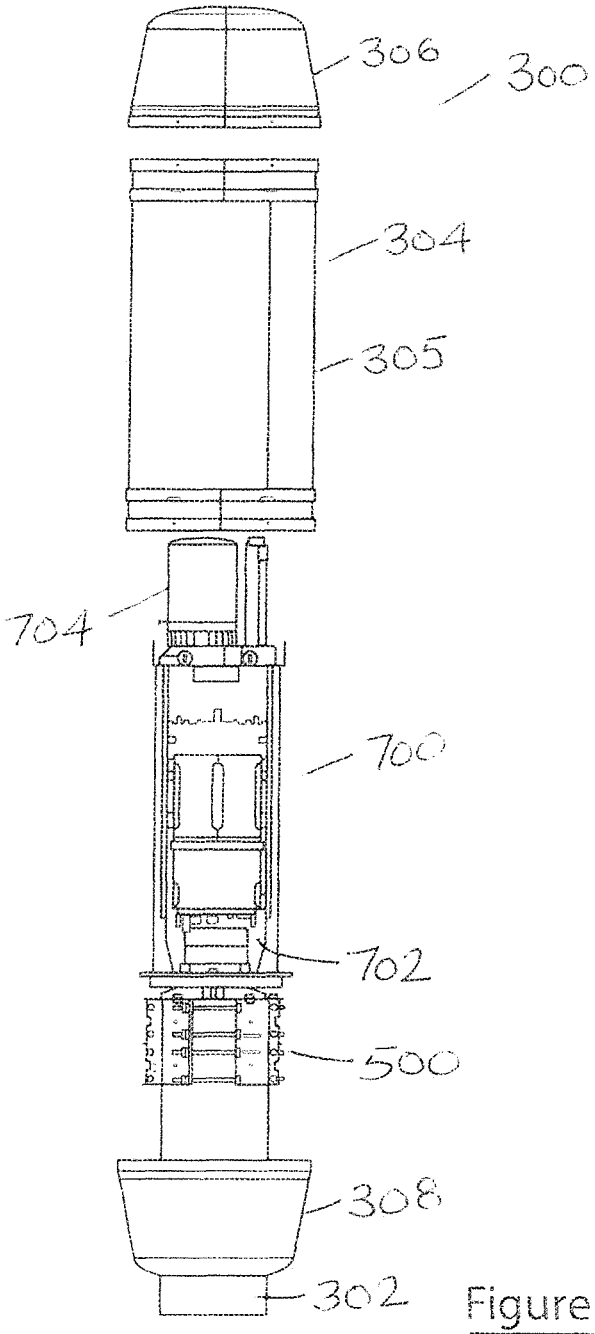
FIG. 16 is an exploded elevational view of a concealed antenna node of the invention.

FIG. 16 is an exploded view of a concealed antenna node 300 of the invention. Parts similar to those described previously are assigned the same reference numerals. In this case, instead of the collar on the lower cap end 308, a universal mounting bracket 500 is provided for mounting the concealed antenna node 300 on the street pole 302.

Figure 17:
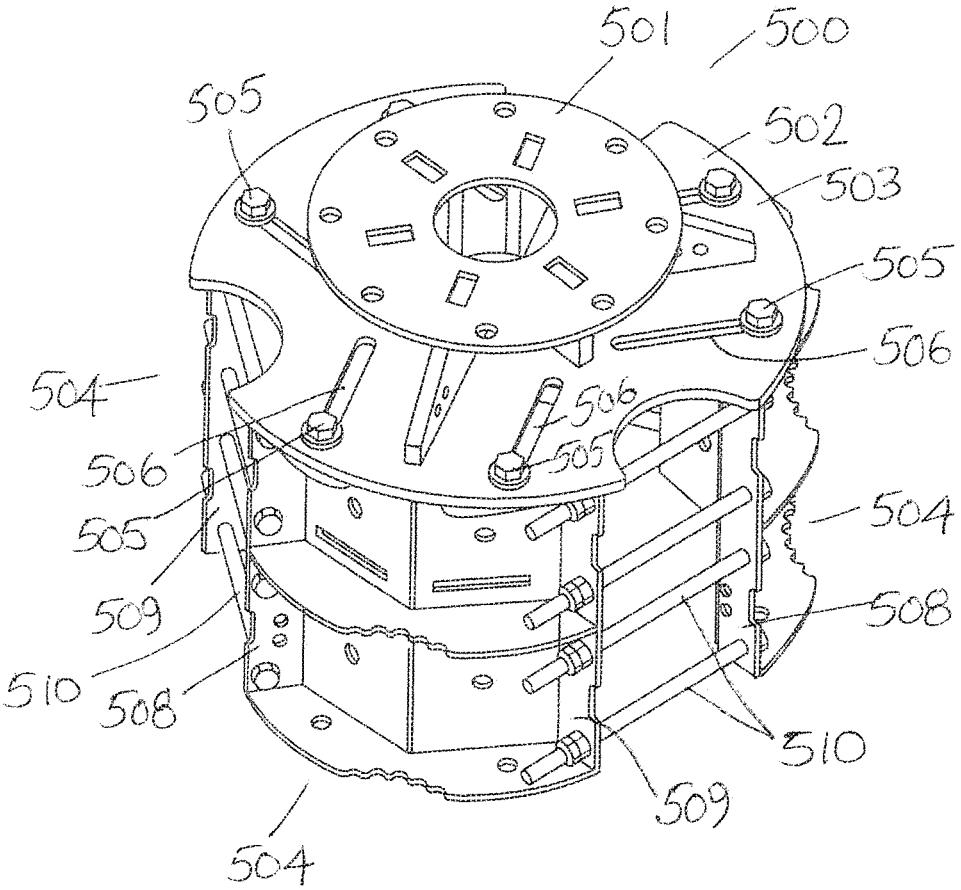
FIG. 17 is a perspective view of a universal mounting bracket for use with the concealed antenna node of the invention.

The universal mounting bracket 500 is shown in more detail in FIG. 17 and comprises a support platform 501 on which the concealed antenna node 300 is mounted and secured. The support platform 501 is mounted on a clamp 502 located directly below the support platform 501. The clamp 502 comprises a circular clamp support plate 503. Three spaced-apart clamp jaws 504 are mounted on the clamp support plate 503 and extend downwardly therefrom. Each clamp jaw 504 is radially slidable on the clamp support plate 503 by means of mounting bolts 505 which slide in associated radial slots 506 in the clamp support plate 503. Each clamp jaw 504 has a V-shaped grip 507 with flanged ends 508, 509. Adjacent clamp jaws 504 are interconnected by clamping bolts 510 extending between the flanged ends 508, 509. The clamping bolts 510 can be tightened as necessary to clamp the jaws 504 about the street pole 302. The universal mounting bracket 500 is housed within the lower cap end 308.

Figure 18:
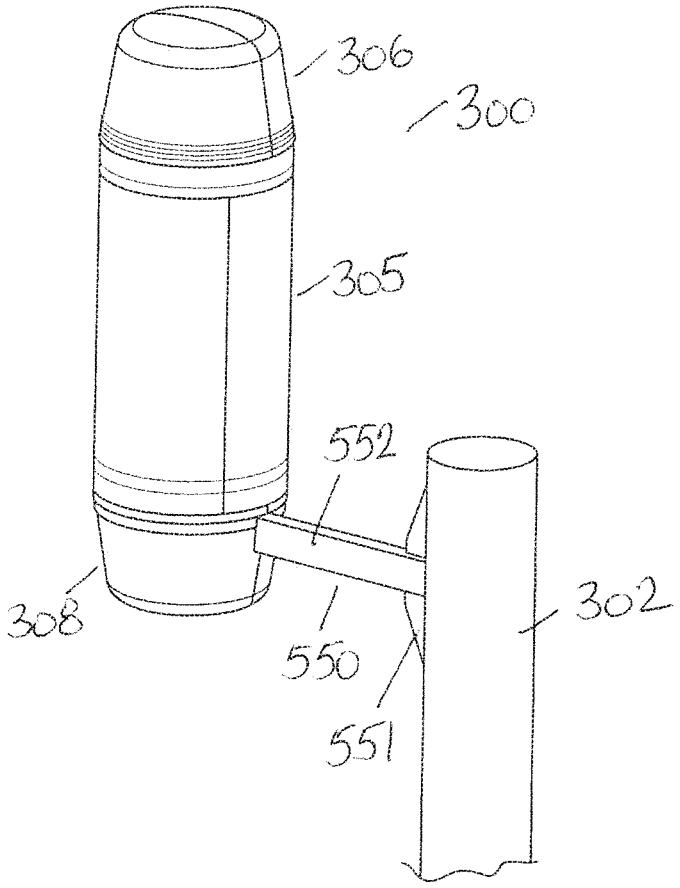
FIG. 18 is a perspective view showing a concealed antenna node of the invention mounted by an offset bracket on a pole.
Figure 19:
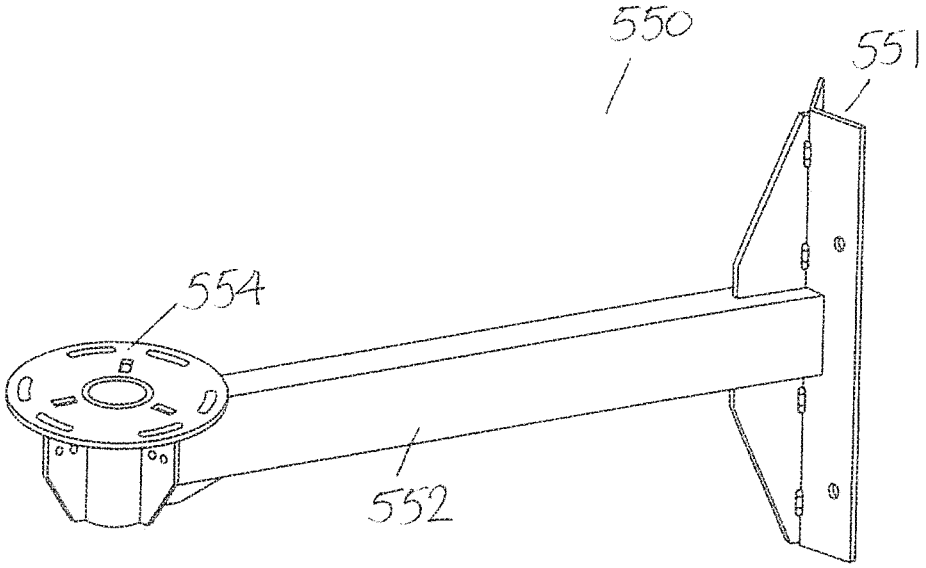
FIG. 19 is a perspective view of the offset bracket.

FIG. 18 and FIG. 19 show a stand-off bracket 550 for mounting the concealed antenna node 300 at one side of the street pole 302 when access is not available to the top of the street pole 302. The stand-off bracket 550 comprises a V-shaped mounting bracket 551 for attachment to the street pole 302. The mounting bracket 551 carries a cantilevered support arm 552 at an outer end of which is a mounting platform 554 upon which the concealed antenna node 300 is mounted. An outer end of the support arm 552 and the mounting platform 554 are housed within the lower cap end 308 in use.

The terms "comprise" and "include", and any variations thereof required for grammatical reasons, are to be considered as interchangeable and accorded the widest possible interpretation.

It will be understood that the components shown in any of the drawings are not necessarily drawn to scale, and, like parts shown in several drawings are designated the same reference numerals.

It will be further understood that features from any of the embodiments may be combined with alternative described embodiments, even if such a combination is not explicitly recited hereinbefore but would be understood to be technically feasible by the person skilled in the art.

The invention is not limited to the embodiments hereinbefore described which may be varied in both construction and detail within the scope of the appended claims.

The invention claimed is:

1. A concealed antenna node suitable for mounting on a street pole, the concealed antenna node comprising:

a radome comprising a cylindrical body having an upper end closed by an upper cap end and a lower end closed by a lower cap end;

an antenna, an associated radio module, and a backhaul which are all housed within the radome of the concealed antenna node;

the antenna comprising a plurality of antenna columns, whereby the plurality of antenna columns are arranged in a ring arrangement about a central section defining a central chamber within which the radio module is mounted;

the radio module being located within the central section and inside the radome; and, the antenna, the radio module, and the backhaul being pre-wired together within the radome to form the concealed antenna node suitable for mounting on the street pole, the radio module sitting inside a cradle installed inside the central section, a vented top plate at a top of the cradle having a through hole, the backhaul sitting on the vented top plate and located within the upper cap end of the radome;

wherein, the plurality of antenna columns are arranged in a spaced-apart formation such that a gap is realised between adjacent antenna columns.

2. The concealed antenna node as claimed in claim 1, wherein, the plurality of antenna columns are arranged in a triangular arrangement about the central section.

3. The concealed antenna node as claimed in claim 1, wherein, the plurality of antenna columns are arranged in a rectangular arrangement about the central section.

4. The concealed antenna node as claimed in claim 1, wherein, the plurality of antenna columns are arranged in a hexagonal arrangement about the central section.

5. The concealed antenna node as claimed in claim 1, wherein, the concealed antenna node further comprises power equipment which is prewired to the antenna and/or radio module and/or backhaul, within the radome.

6. The concealed antenna node as claimed in claim 1, wherein the lower cap end of the radome has an outwardly projecting central collar for reception of a pole to mount the concealed antenna node on the pole.

7. The concealed antenna node as claimed in claim 6, wherein one or both of the upper cap end and the lower cap end has a vent.

8. The concealed antenna node as claimed in claim 7, wherein the upper cap end has a domed top portion with a downwardly depending cylindrical peripheral skirt which attaches to the cylindrical body of the radome, an upper vent being formed by a plurality of circumferentially spaced-apart slots in the skirt.

9. The concealed antenna node as claimed in claim 7, wherein the lower cap end has a domed bottom portion with an upwardly extending cylindrical peripheral skirt which attaches to the cylindrical body of the radome, a lower vent being formed by spaced-apart slots in the bottom portion of the lower cap end.

10. The concealed antenna node as claimed in claim 1 further including a mounting bracket comprising a support platform on which the concealed antenna node is mounted and secured, the support platform being mounted on a clamp located directly below the support platform, the clamp comprising a circular clamp support plate, three spaced-apart clamp jaws mounted on the clamp support plate and extending downwardly therefrom, each clamp jaw being radially slidable on the clamp support plate by means of mounting bolts which slide in associated radial slots in the clamp support plate, each clamp jaw having a V-shaped grip with flanged ends, adjacent clamp jaws being interconnected by clamping bolts extending between the flanged ends.

11. The concealed antenna node as claimed in claim 1 further including a mounting bracket comprising a V-shaped mounting bracket for attachment to a street pole, the mounting bracket carrying a cantilevered support arm at an outer end of which is a mounting platform upon which the concealed antenna node is mounted.

12. A concealed antenna node suitable for mounting on a street pole, the concealed antenna node comprising:

a radome comprising a cylindrical body having an upper end closed by an upper cap end and a lower end closed by a lower cap end;

the upper cap end having a domed top portion with a downwardly depending cylindrical peripheral skirt which attaches to the cylindrical body of the radome, an upper vent being formed by a plurality of circumferentially spaced-apart slots in the skirt:

the lower cap end having a domed bottom portion with an upwardly extending cylindrical peripheral skirt which attaches to the cylindrical body of the radome, a lower vent being formed by spaced-apart slots in the bottom portion of the lower cap end;

an antenna and an associated radio module which are both housed within a radome of the concealed antenna node;

the antenna comprising a plurality of antenna columns, whereby the plurality of antenna columns are arranged in a ring arrangement about a central section defining a central chamber within which the radio module is mounted;

the radio module being located within the central section and inside the radome; and, the antenna and the radio module being pre-wired together within the radome to form the concealed antenna node suitable for mounting on the street pole, wherein, the plurality of antenna columns are arranged in a spaced-apart formation such that a gap is realised between adjacent antenna columns.

13. A concealed antenna node suitable for mounting on a street pole, the concealed antenna node comprising:

a radome comprising a cylindrical body having an upper end closed by an upper cap end and a lower end closed by a lower cap end;

an antenna and an associated radio module which are both housed within a radome of the concealed antenna node;

the antenna comprising a plurality of antenna columns, whereby the plurality of antenna columns are arranged in a ring arrangement about a central section defining a central chamber within which the radio module is mounted;

the plurality of antenna columns being arranged in a spaced-apart formation such that a gap is realised between adjacent antenna columns;

the radio module being located within the central section and inside the radome;

the antenna and the radio module being pre-wired together within the radome to form the concealed antenna node suitable for mounting on the street pole;

a mounting bracket comprising a support platform on which the radome is mounted and secured, the support platform being mounted on a clamp located directly below the support platform, the clamp comprising a circular clamp support plate, three spaced-apart clamp jaws mounted on the clamp support plate and extending downwardly therefrom, each clamp jaw being radially slidable on the clamp support plate by means of mounting bolts which slide in associated radial slots in the clamp support plate, each clamp jaw having a V-shaped grip with flanged ends, adjacent clamp jaws being interconnected by clamping bolts extending between the flanged ends.

* * * * *